US011142718B2

(12) United States Patent
Nagendramma et al.

(10) Patent No.: US 11,142,718 B2
(45) Date of Patent: Oct. 12, 2021

(54) ECOFRIENDLY AND BIODEGRADABLE LUBRICANT FORMULATION AND PROCESS FOR PREPARATION THEREOF

(71) Applicant: Council of Scientific & Industrial Research, New Delhi (IN)

(72) Inventors: Ponnekanti Nagendramma, Dehradun (IN); Anjan Ray, Dehradun (IN); Gananath Doulat Thakre, Dehradun (IN); Neeraj Atray, Dehradun (IN)

(73) Assignee: Council of Scientific & Industrial Research, New Delhi (IN)

( * ) Notice: Subject to any disclaimer, the term of this patent is extended or adjusted under 35 U.S.C. 154(b) by 0 days.

(21) Appl. No.: 16/760,963

(22) PCT Filed: Apr. 26, 2018

(86) PCT No.: PCT/IN2018/050257
§ 371 (c)(1),
(2) Date: May 1, 2020

(87) PCT Pub. No.: WO2019/087205
PCT Pub. Date: May 9, 2019

(65) Prior Publication Data

US 2020/0299602 A1 Sep. 24, 2020

(30) Foreign Application Priority Data

Nov. 3, 2017 (IN) ..... 201711039235

(51) Int. Cl.

| | |
|---|---|
| ***C10M 105/46*** | (2006.01) |
| ***C10M 129/10*** | (2006.01) |
| ***C10M 133/12*** | (2006.01) |
| ***C10M 135/28*** | (2006.01) |
| ***C10M 137/06*** | (2006.01) |
| ***C10M 169/04*** | (2006.01) |
| *C10N 30/00* | (2006.01) |
| *C10N 10/04* | (2006.01) |
| *C10N 30/02* | (2006.01) |
| *C10N 30/06* | (2006.01) |
| *C10N 30/10* | (2006.01) |
| *C10N 30/12* | (2006.01) |
| *C10N 40/06* | (2006.01) |

(52) U.S. Cl.
CPC ..... *C10M 105/46* (2013.01); *C10M 129/10* (2013.01); *C10M 133/12* (2013.01); *C10M 135/28* (2013.01); *C10M 137/06* (2013.01); *C10M 169/04* (2013.01); *C10M 2207/023* (2013.01); *C10M 2207/3045* (2013.01); *C10M 2223/045* (2013.01); *C10M 2223/049* (2013.01); *C10N 2010/04* (2013.01); *C10N 2030/02* (2013.01); *C10N 2030/06* (2013.01); *C10N 2030/10* (2013.01); *C10N 2030/12* (2013.01); *C10N 2030/64* (2020.05); *C10N 2040/06* (2013.01)

(58) Field of Classification Search
CPC ..... C10M 105/46; C10M 2207/023; C10M 2207/3045; C10M 2223/045; C10N 2030/64; C10N 2040/06
USPC ..... 508/485
See application file for complete search history.

(56) References Cited

U.S. PATENT DOCUMENTS

| | | | | |
|---|---|---|---|---|
| 2,836,563 | A | 5/1958 | Dilworth et al. | |
| 3,065,180 | A | 11/1962 | Pethrick et al. | |
| 3,791,488 | A | 2/1974 | Rowe et al. | |
| 4,440,660 | A * | 4/1984 | van Rijs | C07C 69/30 508/485 |
| 5,750,750 | A * | 5/1998 | Duncan | C10M 105/46 554/117 |

(Continued)

FOREIGN PATENT DOCUMENTS

| | | | |
|---|---|---|---|
| CA | 2534902 | A1 | 3/2005 |
| JP | 06025683 | A | 2/1994 |
| RO | 107988 | B1 | 1/1994 |
| WO | 2005019395 | A1 | 3/2005 |
| WO | 2014005932 | A1 | 1/2014 |
| WO | 2015036293 | A1 | 3/2015 |

OTHER PUBLICATIONS

International Search Report and Written Opinion pertaining to PCT/IN2018/050257, dated Jun. 29, 2018.

(Continued)

*Primary Examiner* — Ellen M McAvoy
(74) *Attorney, Agent, or Firm* — Dinsmore & Shohl LLP

(57) ABSTRACT

The present invention discloses with the development of ecofriendly and biodegradable lubricant formulation useful for micro electro mechanical systems and process thereof. The new generation Mineral oil free lubricant formulations were developed by esterification of polyols such as 2,2-dimethyl, 1,3-Propanediol, 2,2-diethyl-1,3-propane diol, and aliphatic di carboxylic acids like adipic and azelaic and with mono alcohol, using heterogeneous catalyst Indion 140 with cation exchange properties. The said formulation has a viscosity in the range of 31 to 47 cSt at 40° C., a high viscosity index of 139-196, pour point of approximately <–39° C. with a multifunctional EP additive of recommended dose of 1.5-4%. These new generation lubricants exhibited excellent biodegradability, a high viscosity index, and a low pour point, a high flash point, good lubricity, good oxidative stability, very good protection, against wear, no evaporation loss, good adherence to metal, corrosion inhibiting characteristics and suitability for use with commercial additives. In addition the products are non toxic to the sewage bacteria.

15 Claims, No Drawings

(56) References Cited

U.S. PATENT DOCUMENTS

| | | | | |
|---|---|---|---|---|
| 5,994,278 | A * | 11/1999 | Duncan | C10M 105/74 508/485 |
| 6,376,435 | B1 | 4/2002 | Hafez et al. | |
| 6,551,968 | B2 | 4/2003 | McHenry et al. | |
| 6,878,418 | B2 | 4/2005 | Ma et al. | |
| 7,695,820 | B2 | 4/2010 | Economy et al. | |
| 8,183,190 | B2 | 5/2012 | Zehler et al. | |
| 2005/0049153 | A1 | 3/2005 | Zehler et al. | |
| 2009/0186787 | A1 | 7/2009 | Scherer et al. | |
| 2016/0145525 | A1* | 5/2016 | Suzuki | C10M 105/46 508/455 |

OTHER PUBLICATIONS

Bisht et al., "Eco-friendly Base Fluids for Lubricant Oil Formulations", Journal of Synthetic Lubrication, 2002, vol. 19, Issue 3, (19) 243.

Gupta et al, "Ultrathin PFPE Film Systems Fabricated by Covalent Assembly: An Application to Tribology", Tribology Letters, 2012, vol. 45, 371-378.

Misra et al., "Complex Esters as Antiwear Agents", WEAR, 1973, vol. 26, Issue 2, 229-237.

Nagendramma et al., "Study of Synthesised Ecofriendly and Biodegradable Esters: Fire Resistance and Lubricating Properties", Lubrication Science, 2010, 103-110.

Nagendramma et al., "Study of Synthetic Complex Esters as Automotive Gear Lubricants", J. Synthetic Lubrication, 2008, 25, 131-136.

Nagendramma et al., "Development of Ecofriendly/Biodegradable Mixed Polyol Ester Base Stocks for Neat Cutting Oils", Indian Institute of Petroleum, www.nlgi-india.org. 12th NLGI-2010.

Singh et al., "Surface Chemical Modification for Exceptional Wear Life of MEMS Materials", AIP Advances, 1, 2011, 042141.

Venkataramani et al., "Precision Instrument Oils", J. Synthetic Lubrication, 1987, 4: 307-319.

Venkataramani et al., "Synthesis Evaluation and Applications of Complex Esters as Lubricants: A Basic Study", Journal of Synthetic Lubrication, 1989, 271-289.

* cited by examiner

ECOFRIENDLY AND BIODEGRADABLE LUBRICANT FORMULATION AND PROCESS FOR PREPARATION THEREOF

FIELD OF THE INVENTION

The present invention relates to the development of ecofriendly and biodegradable lubricant formulations useful for mechanical systems particularly for micro electro mechanical systems (MEMS) and process thereof. The present invention discloses the new generation lube base stocks prepared by esterification of polyols such as 2,2-dimethyl, 1,3-Propanediol, 2,2-diethyl-1,3-propane diol, 1,1,1,-tris hydroxy methyl propane ($C_3$-$C_5$) and aliphatic di carboxylic acids like adipic, azelaic and sebacic acids ($C_6$-$C_{10}$) and with mono alcohol, using heterogeneous catalyst with cation exchange properties. These new generation lubricants exhibited excellent biodegradability, high viscosity index and low pour point, high flash point, good lubricity, good oxidative stability, very good protection against wear, no evaporation loss, good adherence to metal, corrosion inhibiting characteristics and suitability for use with commercial additives. In addition, the products are non-toxic to the sewage bacteria. More specifically this invention relates to employing these new generation lube base stocks for lubrication of chronometers and other delicate high precision instruments that are liable to be exposed to wide range of operating conditions.

BACKGROUND OF THE INVENTION

To meet the challenging requirements of recent technological developments, new and high performing lubricants are being explored all over the globe. In this scenario the new generation high performance bio lubricants have proved to possess a wide scope to deliver. The bio lubricants have already found their way into various industrial and automotive applications. The bio-based products in the form of cutting oils, engine oils, gear and hydraulic oils are now well established in the commercial markets. However, still there are various other domains of engineering and technology where the lubrication and use of bio lubricants is still a challenge. The MEMS is one such domain where the use of biolubricants has not yet been explored.

MEMS refer to miniaturized devices, which are typically made up of combinations of mechanical and electrical components ranging from 1 to 100 μm in size. Components in MEMS usually involve relative motions and exhibit both intended and unintended contacts. This renders MEMS components with high vulnerability owing to the resistive forces. Hence, in order to improve the reliability of MEMS components, there is an urgent need not only to understand the surface forces acting on the contacts but also to develop lubricants and wear resistant coatings for them. The Microelectromechanical industry demands lubricants that possess long service life and are environmentally safe. The criteria of lubricant selection for Micro-electromechanical systems is that they must provide 100% effective lubrication throughout the component life and have low break away torque along with being silent in operation. The requirements of these lubricants are becoming more demanding due to the variety of factors, including miniaturization of electronic and mechanical devices, use of high temperature operating conditions, increased expectation of product lifetimes and the expanding range of operating and storage environments. In addition to the lubrication of surfaces, lubricants also need to offer thermal stability, chemical inertness, wear resistance, low volatility and/or corrosion resistance, depending on the application requirement.

When MEMS components make movements, the high viscosity liquid lubricants cause higher energy dissipation. However, Boundary lubrication is a preferred choice over fluid film lubrication in MEMS. Boundary films are coated onto the target surfaces in order to reduce the energy dissipated during collision. Good candidate of MEMS lubricants typically have these properties: low surface tension, are easily applied to the substrate and are strongly bonded to the substrate, chemical and thermal stability which makes it insensitive to environment.

Traditionally the most common lubricants for MEMS application include Perfluoropolyether (PFPE), mineral oil lubes and phosgene esters. The major disadvantage with the mineral oil based lubes is that they age and oxidize at temperatures above 100° C. and form resins and carbonaceous deposits and hence cannot be used at temperatures exceeding 100° C. Moreover they show poor miscibility with other silicone and PFPE based additives. Similarly, Perfluoropolyether though are very popular for MEMS applications but have certain disadvantages such as degradation at higher temperatures (more than 200° C.) especially in presence of certain materials such as non passivated aluminum, magnesium and titanium alloys. Low surface tension, high density, permeability for water vapors result in poor corrosive protection, poor boundary lubrication are some other limitations associated with Perfluoropolyether.

Reference may be made to the U.S. Pat. No. 6,878,418 B2; 2005 that discloses method of preparing a protective overcoat by depositing diamond like carbon (DLC) coating over a magnetic layer and then depleting a portion of DLC protective layer of hydrogen before coating it with Perfluoropolyether (PFPE) by in-situ vapor lubrication technique.

Reference may be made to another U.S. Pat. No. 3,791,488 (Rowe deceased et al 1974), A novel method of protecting the surfaces in contact with mineral oil using an overlying film consisting of a very high viscosity silicon fluid having viscosity in the range of 500-1500 centistokes.

Reference may be made to another U.S. Pat. No. 7,695,820B2; (Economy et al, 2010) wherein the innovators have claimed a lubricant composition consisting of aliphatic polyesters substituted at alpha and beta positions resulting in increased thermal, chemical and hydrolytic stability as compared to the conventional aliphatic esters and the commonly used PFPE's for their use in high performance lubrication including lubricants for hard discs.

Reference may be made to the publication, Singh et al, Surface chemical modification for exceptional wear life of MEMS materials, AIP ADVANCES 1, 042141 (2011), where the authors have described the chemical modification method of surfaces to reduce friction and significantly extend the wear life of two most popular MEMS structural materials namely, silicon and SU-8 polymer. The surface modifications have been attained using ethanolamine-sodium phosphate buffer, followed by coating of Perfluoropolyether (PFPE) nano lubricant on (i) silicon coated with SU-8 thin films (500 nm) and (ii) MEMS process treated SU-8 thick films (50 μm).

Reference may be made to another publication, Gupta et al, Ultrathin PFPE Film Systems Fabricated by Covalent Assembly: An Application to Tribology, Tribology Letters, and Vol. 45 (2012) Pages 371-378, in which the authors have deposited anhydride-functionalized polymer over an amine-functionalized silicon surface through covalent bonding. The intermediate layer between derivative silicon and Perfluoropolyether (PFPE) act as nano-lubrication in several applications, such as information storage devices and micro-electromechanical systems.

Reference may be made to the publication (P S Venkataramani et al., J. Synthetic Lubrication, 4: 307-319, 1987), on precision instrument oils. The authors have discussed the physico-chemical and performance characteristics of developed watch oil, to show how it meets the basic requirements of the watch lubricants, and compares favorably with widely accepted watch oils.

Reference may be made to the U.S. Pat. No. 3,065,180 (Samuel Richard Pethriclr and Maurice Harrington Sparke, Sunbury-on-Tharnes, Nov. 20, 1962) that relates to the synthetic lubricants consisting of a blend of liquid aliphatic di ester of saturated aliphatic dicarboxylic acid and polyester showing possible application in aero gas turbine lubrication. The patent discloses Lubricant composition as blend of two components: (i) The di esters synthesized by treating sebacic acid with ethyl hexyl alcohol, and (ii) The poly esters of neopentyl glycol treated with sebacic, iso sebacic, and 2,2,4 tri methyl adipic acids by using one step esterification in presence of nitrogen atmosphere.

Reference may be made to the publication (Ponnekanti Nagendramma, Savita Kaul, R. P. S. Bisht M. R. Tyagi, www.nlgi-india.org. 12$^{th}$ NLGI-2010) on development of ecofriendly/biodegradable mixed polyol ester base stocks for neat cutting oils. The authors report a number of esters synthesized by using polyols with mixtures of mono basic acids ranging from $C_6$-$C_{12}$ and the applicability of these esters as neat cutting oils.

The performance and life of PFPE lubricants are however limited and predicted by their thermal and chemical stability, as well as their static friction and adhesion properties. Fluoroethers degrade chemically at elevated temperatures and on exposure to the Lewis acidity material typically present on systems.

Reference may be made to the publication (Ponnekanti Nagendramma and Savita Kaul, J. Synthetic Lubrication, 25, 131-136, 2008) on study of synthetic complex esters as automotive gear lubricants. This paper reports a number of di- and triol-centered polyol complex esters synthesized using indigenous ion-exchange resin (Indion-130) catalyst and their applicability as automotive gear lubricants. The extreme pressure additives were added to the synthesized products to improve the load bearing and anti-wear properties.

Reference may be made to publication (R. P. S. Bisht, Savita Kaul, P. Nagendramma, V. K. Bhatia, A. K. Gupta, Journal of Synthetic Lubrication, Volume 19, Issue 3, October 2002. (19) 243 on Eco-friendly base fluids for lubricant oil formulations. The paper reports synthesis of various polyol esters using $C_6$-$C_{14}$ carboxylic acids and $C_5$ polyols using Eco-friendly catalysts IIP $C_1$-IIP $C_4$ asserting the applicability of the synthesized esters as automotive transmission fluids. The commercial Tri aryl phosphate (1%) additive was added to the synthesized products to improve the auto ignition and anti-wear properties. Reference may be made to the publication (Ponnekanti Nagendramma, Savita Kaul and R. P. S. Bisht, Lubrication Science, 22, 103-110, 2010) on study of synthesized ecofriendly and biodegradable esters: fire resistance and lubricating properties. The paper reports synthesis of various polyol esters using 2-methyl 2-n-propyl 1,3-propane diol, 2,2-di methyl 1,3-propane diol, 1,1,1-[tris] hydroxyl methyl propane, 1,1,1-[tris] hydroxyl methyl ethane, Carboxylic acids ($C_6$-$C_{12}$) both in pure and mixture forms and 2-ethyl-1 hexanol with Indigenous ion exchange resin (indion-130) catalyst and the applicability of these esters as fire resistant hydraulic fluids. The commercial Tri aryl phosphate (1%) additive was added to the synthesized products to improve the auto ignition and anti-wear properties.

Reference may be made to U.S. Pat. No. 6,551,968B2 (Mchenry et al Apr. 22, 2003), biodegradable poly neopentyl polyol based synthetic ester blends and lubricants thereof. The invention provides a novel biodegradable poly neopentyl polyol (PNP) ester based synthetic base stock that includes PNP ester admixed with dicarboxylic acid ester as coupling agent. The PNP ester-coupling agent mixture is blended with minor amounts of single or mixture of, additional high molecular weight linear or branched chain ester. The final base stocks are compatible with standard lubricant additive packages and miscible with gasoline resulting in biodegradable lubricants that have improved viscosity characteristics, good low temperature properties, and improved lubricity for 2-stroke engine applications. (Blends are used for 2-stroke engine oils).

Reference may be made to another patent U.S. Pat. No. 8,183,190 B2,CA2534902A1, EP1656437A1, EP1656437A4, US20050049153, WO2005019395A1; (Zeheler, Eugene; Costello; Christopher et al, May 22, 2012), Complex polyol esters with improved performance. A biodegradable lubricant composition containing a complex polyol ester having a polyfunctional alcohol residue and a saturated or unsaturated dicarboxylic acid residue having from about 9 to about 22 carbon atoms. Reference may be made to patent WO 2014005932 A1; (Markus Scherer, Boris Breitscheidel et al, Jan. 9, 2014), the use of carboxylic acid esters as lubricants. The invention directs use of carboxylic acid esters that had been obtained by reacting aliphatic dicarboxylic acids and a mixture of structurally different mono alcohols having 10 carbon atoms as lubricants and a process for their preparation.

Reference may be made to the patent WO2015/036293; (Scherer, Markus; Rinklieb, Ronny et al, September, 2016), Polyester and use of polyester in lubricants, wherein the inventors have reported a lubricant composition synthesized using aliphatic dicarboxylic acids having 5 to 20 carbon atoms and cyclo aliphatic dicarboxylic acid having 4 to 36 carbon atoms (glutaric acid, azelaic acid, sebacic acid, adipic acid, pimelic acid, suberic acid, undecanedioic acid, dodecanedioic acid, brassylic acid, tetradecanedioic acid, pentadecanedioic acid, hexadecanedioic acid and octadecanedioic acid) and one polyol with a hydroxyl functionality in the range of ≥2 to ≤6. The catalyst used for the synthesis was selected from the group consisting of titanium-, zirconium- and tin-containing compounds.

Reference may be made to the publication (A. K. Misra. A. K. Mehrotra. R. D. Srivastava. A. N. Nandy, Wear, Volume 26, Issue 2, Pages 229-237, November 1973), complex esters as antiwear agents, wherein the authors have synthesized a number of Diol centered complex esters using diols (diethylene glycol, 1,3-butane diol, neopentyl glycol, polyethylene glycol (molecular weight 200-1000), 1-phenoxy 2,3 propane diol), dibasic acid (sebacic acid) and monohydric alcohols (2-ethyl hexanol) with p-Toluenesulfonic acid (PTSA) as catalyst. The synthesized products were found to be effective antiwear agents.

Reference may be made to the U.S. Pat. No. 5,750,750A (Carolyn Boggus Duncan, Paul R. Geissler, David Wayne Turner, William Joseph, Munley, Jr., Martin A. Krevalis et al Feb. 7, 1997), High viscosity complex alcohol esters, that reports the composition of complex alcohol ester comprising of polyhydroxyl compound aliphatic or cycloaliphatic, C2-C20, —OH≥2; a polybasic acid or an anhydride of a polybasic acid; and a monohydric alcohol. The selected polybasic or polycarboxylic acids include any of the $C_2$ to $C_{12}$ diacids, e.g. adipic, azelaic, sebacic and dodecanedioic acids and the monohydric alcohol is either isodecyl alcohol or 2-ethylhexanol. The patent also discloses the process for producing complex alcohol ester using low content of metal catalyst and low total acid number.

Reference may be made to the Japanese patent JP06025683A, (Sakai Akimitsu, Hagiwara Toshiya et al Jul. 9, 1992), Composition for refrigerator working fluid, that discusses the method of ester preparation by reacting an aliphatic polyalcohol, aliphatic monoalcohol and polycarboxylic acid (derivative). The Ester is mixed with refrigerator oil and a hydro fluorocarbon for excellent lubricating properties, heat stability, etc. and used as refrigerator lubricant.

Reference may be made to the US patent US2009186787A1 (Scherer Markus, Busch Stefan, Roeder Juergen, Iking Rudolf, Rettemeyer Dirk, Bala Vasu et al Jun. 13, 2006), Lubricant compounds containing complex esters, that includes complex ester obtained from the reaction of polyols, mono-alcohols and dicarboxylic acids. The synthesized products are used as lubricants for vehicle transmission, axle, industrial drives, compressors, turbines or engines. The polyols disclosed are branched or linear alcohols of the general formula $R^1$ (OH) n in which $R^1$— is an aliphatic or cycloaliphatic group having from 2 to 20 carbon atoms and n is at least 2. The preferred polyols included neopentyl glycol. The monoalcohol used were also branched or linear alcohols of the general formula $R^2OH$ in which $R^2$— is an aliphatic or cycloaliphatic group having carbon atoms ranging from 2 to 24 and bears 0 and/or 1, 2 or 3 double bonds. The preferred monoalcohol included 2-ethylhexyl alcohol. The dicarboxylic acids used were preferably oxalic acid, malonic acid, succinic acid, glutaric acid, adipic acid, pimelic acid, suberic acid, azelaic acid, sebacic acid, brassylic acid, thapsic acid and phellogenic acid.

Reference may be made to another U.S. Pat. No. 6,376,435B1, (Mahmoud Mostafa Hafez, Ulrich Witten, Paul Simon Woolley, Hiroki Kurosawa et al May 19, 1999), Lubrication system for internal combustion engines (law 952) that discloses a binary two phase engine oil composition having two substantially immiscible liquid phases and exhibiting improved fuel economy which is maintained over an extended period. The first liquid phase comprises of base oil, natural or synthetic. The second liquid phase is a polar organic liquid, preferably a complex alcohol ester, preferably derived from a polyol, a polybasic acid, and a monohydric alcohol.

Reference may be made to the Proceedings of World Conference on Industrial Tribology 1ST (1973), (Misra, A. K.; Kalra, S. L.; Srivastava. A. N, R. D.; Nandy, A. N.; Nanda, J. N 1973) on Lubricants for precision mechanisms. The authors reported lubricants for clocks and watches. 39 ester, ether-ester and diester type derivatives of glycerol, glycols and monohydric alcohols were evaluated in terms of viscosity at 100° F., pour point, % spreading on glass surface, stability to oxidation and humidity. Only 2 complex esters of sebacic acid with 1,3-butanediol and 2-ethylhexanol (I) or neopentyl glycol, 1-benzoyloxy-2-propanol and I as alc. components, passed all the tests except spreading which was reduced by using an N-alkyl piperidine derivative of higher fatty acid as an anti spreading additive.

Reference may be made to Venkataramani P S, Kalra S L, Raman S V, Srivastava H C. Synthesis evaluation and applications of complex esters as lubricants: a basic study. *Journal of Synthetic Lubrication* 1987; 5(4): 271-289, the authors have described the synthesis of some complex esters based on Neo polyols (NPG & THMP) esters using p-toluene sulfonic acid as catalyst. However the major drawback associated with the said process is that it is quite cumbersome and yield products that require continuous monitoring resulting in inferior quality base oils with significant acidity and charred products.

The existing state of art reveals that most of the patents and information published in open literature is related to the techniques of synthesis and use of existing lubricants such as Perfluoropolyether (PFPE), phosphazene, mineral oil compositions etc. for MEMS applications. Further, the cited literature is confined towards increasing the wear life of existing MEMS lubricants.

Therefore there is a need to develop mineral oil free, ecofriendly biodegradable lubricant formulation to avoid limitations of the existing lubricating formulations for mechanical systems particularly MEMS.

OBJECTS OF THE INVENTION

The main objective of the present invention is to develop an ecofriendly and biodegradable mineral oil free lubricant formulation useful for lubrication of chronometers and other delicate precision components of micro electro mechanical system based devices like delicate bearings, gauges, meters, clocks etc which obviates the drawbacks of prior art.

Another objective of the present invention is to provide a process for preparation of lubricant formulation.

Yet another objective of the present invention is to develop the ester base oil with a viscosity grade of 31.0 to 47.0 cSt at 40° C. as per IS: 1448: P-25 specification and possessing a high viscosity index of 161-171 as per P-56.

Still another objective of the present invention is to develop the ester base oil with a low pour point of approximately <−39° C. as per IS: 1448: P-10.

Yet another objective of the present invention is to develop the ester base oil with a high flash point (210-232° C.) as per ASTM D: 92.

Yet another objective of the present invention is to develop the ester base oil with a good oxidation stability with the change in kinematic viscosity being <10% with no peroxide formation and no sign of corrosion on copper spirals.

Yet another objective of the present invention is to develop the ester base oil with no evaporation loss.

Yet another objective of the present invention is to develop the ester base oil with very good wear protection with wear scar diameter of 0.350 mm at 40 kgf load as per ASTM D: 4172B.

Yet another objective of the present invention is to develop the ester base oil with good adherence to metal characteristics, with the contact angle in the range of 22-29° and the diameter being <15% on polished mild steel substrates.

Still another objective of the present invention is to develop the ester base oil with good corrosion inhibiting characteristics with steel and brass specimens.

Yet another objective of the present invention is to develop the ester base oil with good lubricity with average friction values in the range of 0.098-0.11 and wear scar values of approx. 180 μm for loads ranging from 20-30N and sliding speeds of 0.1-0.5 m/sec.

Yet another objective of the present invention is to synthesize a product that has low specific wear rate as compared to or better than the existing conventional mineral oil base lubricant.

Yet another objective of the present invention is to develop the ester base oil with excellent biodegradability with no toxicity. The biodegradability of the synthesized ester is above 95% as per the standard ASTM D: 5864 test method for biodegradability. The products are non toxic to the sewage bacteria.

Yet another objective of the present invention is conventional additives which are suitable for mineral oils are also giving positive response with this ester.

Yet another objective of the present invention is to develop the ester base oil with excellent load bearing capacity with the elastohydrodynamic (EHD) film thickness in the range of 60-180 nm for the loads ranging from 20-30 N.

Yet another objective of the present invention is to develop the ester base oils which are comparable with MEMS lube base oils meeting the requirements of commercial chronometers and other delicate precision instrument oils specifications.

Yet another objective of the present invention is to develop the ester base oil with excellent biodegradability, high viscosity index and low pour point, high flash point, very good lubricity, good oxidation stability and property of preventing corrosion and suitable for use with sealing materials.

Still another objective of the present invention is to develop the ester base oil with the synthesized products when blended with Zinc dialkyl dithio phosphate (ZDDP) as multifunctional EP additive in recommended doses of 1.5-4% improve the weld load and antiwear performance by approximately 30%.

Still another objective of the present invention is to synthesize the product which passes the 100 hour oxidation stability test. After this anti oxidant additives 2,6-di tertiary butyl 4, methyl Phenol was added.

Yet another objective of the present invention is to develop the ester base oil with high purity polyol complex esters with negligible acidity. The products obtained by this invention can be used as biodegradable and ecofriendly lubricants in chronometers and other delicate components in MEMS devices and is completely ecofriendly and biodegradable as per ASTM D: 5864-2009 method where as hitherto conventional MEMS oils are not biodegradable containing mineral oil and PFPEs as base stock and synthesized using conventional catalysts.

Still another objective of the present invention is to develop ester base oil formulations for MEMS applications, by using commercial mineral oil additives which are being used in commercial formulations.

Yet another objective of the present invention is to synthesize an eco friendly and biodegradable MEMS lube base oils with polyol complex esters as base oils meeting the requirements of commercial chronometers and other delicate instrument oil specifications.

SUMMARY OF THE INVENTION

Accordingly, the present invention provides a mineral oil free lubricant formulation, wherein the formulation comprises:

polyol complex ester selected from the group consisting of 2,2-diethyl, 1,3-Propane-Di azelaic-2-ethyl-1-hexanoate, 2,2-dimethyl, 1,3-propane-Di adipic-2-ethyl-1-hexanoate, and mixture thereof; and optionally an antioxidant; and optionally an additive.

In another embodiment, the formulation comprises:

(i) polyol complex esters in the range of 94% to 100%;

(ii) antioxidant in the range of 0-2%; and (iii) additive in the range of 0 to 4%.

In yet another embodiment of the invention, the formulation has a viscosity in the range of 31 to 47 cSt at 40° C., a high viscosity index of 161-171, pour point of approximately <−39° C., operational temperature in the range of −45° C. to 285° C.

In an embodiment of the present invention the ratio of polyol complex esters is in the ratio of 1:1 to 1:3.

In yet another embodiment of the present invention the ratio of polyol complex ester is 1:1.

In still another embodiment of the present invention the antioxidant is selected from the group consisting of 2,6-di tertiary butyl 4, methyl Phenol (BHT), alkylated diphenylamine, 3,7-di-t-octylphenothiazine, alkylated PANA, and di-t-butyl-p-cresol (DBPC).

In another embodiment of the present invention, the additive is selected from the group consisting of Zinc dialkyl dithio phosphate (ZDDP), 5,5-dithiobis-(1,3,4-thiadiazole-2(3H)-thione), Di Methyl Hydrogen Phosphite, Di Butyl Hydrogen Phosphite, Di-n-Octyl Hydrogen Phosphite, Di-2-Ethylhexyl Hydrogen Phosphite, Di Oleyl Hydrogen Phosphite, Di Lauryl Hydrogen Phosphite, Tri-Lauryl Tri Thiophosphite, Tri-Lauryl Phosphite, Tri-$C_{12}$-$C_{14}$ Phosphite, and Tri-$C_{12}$-$C_{14}$ Phosphite.

In another embodiment of the invention wherein the formulation comprises the base oil when blended with Zinc dialkyl dithio phosphate (ZDDP) as multifunctional EP additive in recommended doses of 1.5-4% improve the weld load and antiwear performance by approximately 30%.

A further embodiment of the present invention provides a process for synthesizing the mineral oil free lubricant formulation as claimed in claim 1, wherein the process comprises the steps of:

(i) reacting a mixture of polyol of $C_3$-$C_5$ carbon, dicarboxylic acid of $C_6$-$C_{10}$ carbon in a ratio of 1:2 in presence of a heterogeneous catalyst and a solvent at refluxing temperature for a period ranging between 2 to 4 hours to obtain a reaction mixture;

(ii) removing water from said reaction mixture and allowing the mixture to cool to obtain cooled mixture;

(iii) reacting the cooled mixture of step (ii) with at least 2 moles of mono alcohol under reflux condition until all remaining carboxylic groups are esterified, and completing the reaction in a period ranging from 8 to 12 hours, until water is removed to obtain Polyol complex esters as base oil; and (iv) blending the base oil obtained in step (iii), wherein the base oil is 94% to 100% with antioxidant 1-2% and an additive 1.5 to 4%, to obtain the mineral oil free lubricant formulation.

In still another embodiment of the present invention the polyol is selected from the group consisting of 2,2-dimethyl 1,3-propane diol, 2,2-diethyl-1,3-propane diol, and 1,1,1,-tris hydroxy methyl propane.

In yet another embodiment of the present invention the dicarboxylic acid ($C_6$-$C_{10}$) is selected from the group consisting of adipic acid, azelaic acid, and sebacic acid.

In another embodiment of the present invention wherein the mono alcohol in step (iii) is selected from the group consisting of 2-ethyl-1-hexanol, isooctanol, nonanol, and isodecanol.

In yet another embodiment of the present invention the solvent is selected from toluene or xylene.

In a further embodiment of the present invention, the antioxidant is selected from the group consisting of 2,6-di tertiary butyl 4, methyl Phenol (BHT), alkylated diphenylamine, 3,7-di-t-octylphenothiazine, alkylated PANA, and di-t-butyl-p-cresol (DBPC).

In still another embodiment of the present invention, the additive is selected from the group consisting of Zinc dialkyl dithio phosphate (ZDDP), 5,5-dithiobis-(1,3,4-thiadiazole-2 (3H)-thione), Di Methyl Hydrogen Phosphite, Di Butyl Hydrogen Phosphite, Di-n-Octyl Hydrogen Phosphite, Di-2-Ethylhexyl Hydrogen Phosphite, Di Oleyl Hydrogen Phosphite, Di Lauryl Hydrogen Phosphite, Tri-Lauryl Tri Thiophosphite, Tri-Lauryl Phosphite, Tri-$C_{12}$-$C_{14}$ Phosphite, and Tri-$C_{12}$-$C_{14}$ Phosphite.

In yet another embodiment of the present invention, the heterogeneous catalyst is Styrene di-vinyl benzene copolymer resin (Indion 140) with sulphonic acid functionality.

In a further embodiment of the invention, the catalyst is a cationic ion exchange resin of macro porous cross-linked poly styrene (H+ ion 4.8 minimum dry, meq/g, Wet, meq/ml 1.7 minimum) in —$SO_3H$ with particle size in the range of 0.42-1.2 mm.

In another embodiment of the present invention, the reaction temperature in steps (i) and (ii) is in the range of 107-115° C. at atmospheric pressure.

In another embodiment of the invention the product has the following features:

(i) biodegradability of synthesized ester is above 95% as per ASTM D: 5864 test method for biodegradability, (ii) wherein the products are non toxic to the sewage bacteria, (iii) wherein the products have excellent load bearing capacity with the elastohydrodynamic (EHD) film thickness in the range of 60-180 nm for the loads ranging from 20-30 N, (iv) wherein the products have good oxidation stability with the change in kinematic viscosity being <10% in the operating temperature range of 30° C.-100° C., with no peroxide formation and no sign of corrosion on copper spirals.

(v) wherein the functional operating temperature is in the range of 45° C. to 285° C. as determined using Differential Scanning Calorimetry (DSC), (vi) wherein the products have good adherence to metal characteristics with the contact angle in the range of 22-29° and the diameter change being <15% on polished mild steel substrates, (vii) wherein the products have good corrosion inhibiting characteristics with steel and brass specimens, (viii) wherein the synthesis process employed yielded high purity polyol complex esters with negligible acidity, (ix) wherein the products obtained by this invention can be used as a biodegradable and ecofriendly MEMS chronometers and other delicate instrument oils which are completely ecofriendly, biodegradable as per ASTM D: 5864-2009 method where as hitherto conventional MEMS oils are not biodegradable containing mineral oil and PFPEs as base stock and are synthesized by using conventional catalysts.

In an embodiment of the present invention, the base oil is employed for use as a lubricant.

Another embodiment of the present invention provides a polyol complex ester of formula A, Formula A

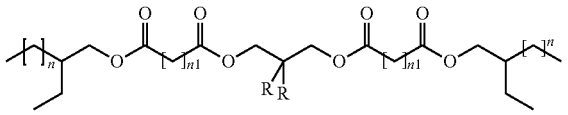

wherein n is 3, $n_1$ is 4 to 8,

R is an alkyl selected from C1 to C5.

Abbreviations

ASTM: American Standard for Testing Materials
MEMS: Micro-electromechanical systems
DMPD: 2,2-dimethyl, 1,3-Propanediol,
DEPD: 2,2-diethyl-1,3-propane diol,
$C_3$-$C_5$: Carbon Number 3-5 alcohols
$C_6$-$C_{10}$: Carbon Number 6-10 acids
AD: Adipic
AZ: Azelaic
PFPE: Perfluoropolyether
PNP: poly neopentyl polyol ester
EH: 2-ethyl hexanol
PTSA: p-Toluene sulfonic acid
NPG: Neo Pentyl Glycol
THMP: 1,1,1,-tris hydroxy methyl propane
THME: 1,1,1,-tris hydroxy methyl Ethane
PFPE: Perfluoropolyether
IS: Indian Standards
cSt: Centi stroke
EHD: Elasto hydrodynamic.
ZDDP: Zinc dialkyl di thio phosphate
BHT: 2,6-di tertiary butyl 4, methyl Phenol (Butylated hydroxy Toluene)
EP: Extreme Pressure
DSC: Differential Scanning Calorimetry
DEAZEH: 2-diethyl, 1,3-Propane-Di azelaic-2-ethyl-1-hexanoate
DMADEH: 2,2-dimethyl, 1,3-Propane-Di adipic-2-ethyl-1-hexanoate

DETAILED DESCRIPTION OF THE INVENTION

No systematic study has been carried out so far on the polyol complex esters as MEMS lube base stocks. In the present investigation, we report the studies carried out on the synthesis, physicochemical characterization and performance evaluation of polyol complex esters and suitability of these esters as lubricant formulations for chronometers and other delicate high precision components used in microelectromechanical systems.

To the best of inventor's knowledge very few reports in the open literature are available on the preparation of polyol ester base stocks and its application in neat cutting oils and automotive gear oils. However the present invention intends towards development of a new lubricating composition that is ecofriendly and biodegradable for micro electro mechanical system applications.

In the present investigation, we have synthesized complex esters of 2,2 di methyl 1,3 propane diol and 2,2 di ethyl 1,3 propane diol, adipic, azelaic acids and 2-ethyl 1-hexanol by using two step esterification with indigenous commercial ion exchange resin catalyst. The use of this catalyst has advantages over conventional catalysts, (i) being indigenous and (ii) recycled two times without loss of reactivity.

The present invention thus overcomes all the shortcomings of the existing state of art. It describes biodegradable and eco-friendly new generation lube base stocks prepared by two step esterification of polyols such as 2,2-dimethyl, 1,3-Propanediol, 2,2-diethyl-1,3-propane diol and aliphatic di carboxylic acids like adipic and azelaic acids with mono alcohol using a heterogeneous ion exchange resin catalyst and its application in chronometers and other delicate precision components for MEMS based devices like delicate bearings, gauges, meters, clocks etc which are liable to be exposed to wide range of operating conditions.

The present invention is to develop the ester base oil with excellent biodegradability, high viscosity index and low pour point, high flash point, very good lubricity, good oxidation stability and property of preventing corrosion and suitable for use with sealing materials.

The present invention is to develop the ester base oil with the synthesized products when blended with Zinc dialkyl dithio phosphate (ZDDP) as multifunctional EP additive in recommended doses of 1.5-4% improve the weld load and antiwear performance by approximately 30%.

One of the features is that the product passes the 100 hour oxidation stability test. After this anti oxidant additives 2,6-di tertiary butyl 4, methyl Phenol was added.

One more feature of the invention is that the ester base oil with high purity polyol complex esters with negligible acidity. The products obtained by this invention can be used as biodegradable and ecofriendly lubricants in chronometers and other delicate components in MEMS devices and is completely ecofriendly and biodegradable as per ASTM D: 5864-2009 method where as hitherto conventional MEMS oils are not biodegradable containing mineral oil and PFPEs as base stock and synthesized using conventional catalysts.

The ester base oil formulations for MEMS applications, by using commercial mineral oil additives which are being used in commercial formulations.

Another feature of the invention is that invention provides an eco friendly and biodegradable MEMS lube base oils with polyol complex esters meeting the requirements of commercial chronometers and other delicate instrument oil specifications.

Accordingly, the present invention provides a new, ecofriendly and biodegradable lubricant for micro electro mechanical systems. In this invention new generation lube base stocks were prepared by esterification of polyols such as 2,2-dimethyl, 1,3-Propanediol, 2,2-diethyl-1,3-propane diol, and aliphatic di carboxylic acids like adipic and azelaic acids and with mono alcohol, using Indion 140 as heterogeneous catalyst. More specifically this invention relates to employing these new generation lube base stocks for lubrication of chronometers and other delicate precision components like delicate bearings, gauges, meters, clocks etc for MEMS based devices which are likely to be exposed to wide range of operating conditions.

Accordingly, the present invention relates to development of a new ecofriendly and biodegradable ester base stock for micro electro mechanical systems in a process comprising of:

1. Esterification of polyols with dicarboxylic acid and mono alcohols in the presence of heterogeneous catalyst wherein:
   (i) The di carboxylic acids belong to the carbon range of $C_6$-$C_{10}$ such as adipic and azelaic acids.
   (ii) The polyols belong to the range of $C_3$-$C_5$ such as 2,2-dimethyl, 1,3-Propanediol, 2,2-diethyl-1,3-propane diol and mono alcohol used was 2-ethyl-1-hexanol.
   (iii) The ratio of polyols to di carboxylic acids to mono alcohol falls in the range of 1:2:2 for synthesis of diols.
   (iv) The heterogeneous catalyst is Indion 140 used at a concentration of 25 (% wt) without loss of substantial reactivity even after 2 recycles.
2. Heating the reactants in the temperature range of 107 to 115° C. for the reaction time of 8-12 hrs to obtain complex esters.
3. Washing the products with water followed by drying and separating the product by recovery of solvent to develop a product with following characteristics:
   (i) Biodegradable MEMS lube base stocks synthesized from polyol alcohols.
   (ii) The formulated products have good lubricity and anti wear properties.
   (iii) The formulated product has excellent load bearing capacity.
   (iv) The ester base oil formulations obtained by this invention can be used as MEMS lubricating oils which are completely ecofriendly and biodegradable as per ASTM D: 5864-95 method where as hitherto conventional mineral based MEMS lubricating oils are not biodegradable.

The present invention utilized the $C_3$-$C_5$ polyol alcohols, $C_6$-$C_{10}$ aliphatic di carboxylic acids and $C_8$ mono alcohol, anti oxidant additive in a molar ratio of 1:2:2 as starting material in place of conventional oils which are toxic and non biodegradable.

Another feature of the present invention is the use of non conventional indigenous commercial ion exchange resin Indion-140 as catalyst.

In an embodiment of the present invention the polyol complex ester base oils may be selected from the viscosity range of 34.26 to 43.54 cSt at 40° C. as per IS: 1448: P-25 matching the specification and a high viscosity index of 161-171 as per P-56.

In another embodiment of the present invention the polyol alcohols taken were 2,2-dimethyl-1,3-propanediol, 2,2-diethyl-1,3-propanediol and mono alcohol, 2-ethyl-1-hexanol.

In yet another embodiment of the present invention the acids used were aliphatic di carboxylic acids having carbon range of $C_6$-$C_{10}$ (adipic and azelaic acids).

In yet another embodiment of the present invention the mono alcohol used was 2-ethyl-1-hexanol.

In still another embodiment of the present invention the solvents used were toluene and xylene.

In still another embodiment of the invention the heating was carried out in the temperature range of 107 to 115° C.

In still another embodiment of the invention heating and stirring was continuously carried out from 8-12 hours.

In still another embodiment of the invention the MEMS polyol complex esters were synthesized by using non conventional, indigenous, commercial ion exchange resin (Indion-140) catalyst.

In still another embodiment of the present invention the recovered catalyst was used two times for diols without any loss of reactivity only reaction time was increased.

In still another embodiment of the present invention the use of non conventional, indigenous, commercial catalyst affords the derived product with negligible acidity. The process has superiority with respect to ease of handling, less reaction time, high purity, cost effectiveness because of recyclable nature, energy saving and yields of the order of 90% and above.

In still another embodiment of the present invention the synthesized esters were characterized by IR spectroscopy. The IR spectrum of polyol complex esters shows characteristic peak of ester at 1746 $cm^{-1}$. The ester carbonyl frequency and the ester carbon-oxygen stretching appeared at 1746 $cm^{-1}$ and 1158 $cm^{-1}$ respectively. Strong band at lower frequency between 1158 and 1000 $cm^{-1}$ are of aliphatic esters. Peak at 723 $cm^{-1}$ is due to long alkyl chain present in lube. The ester carbon-hydrogen stretching and bending was observed at 3007-2854 $cm^{-1}$ and 1379-1466 $cm^{-1}$. There were no bands corresponding to —COOH and —OH groups indicating the total esterification of all the —$CH_2OH$ groups of alcohol and complete conversion of —COOH groups.

In still another embodiment of the present invention the products of present invention for MEMS chronometer and other delicate instrument are completely biodegradable as per ASTM D: 5864-2004.

In still another embodiment of the present invention the products of present invention which are non toxic to the sewage bacteria as per modified method of Algal inhibition test, official journal of the European communities No. L 383 A/179-185 (1993) can be used as lubricants for MEMS chronometer and other delicate instrument oils.

The synthesized products have the following characteristics:

a. The prepared esters have viscosity grade of 31.0 to 47.0 cSt at 40° C. as per P-25 matching the specification and a high viscosity index of 161-171 as per P-56.
b. The synthesized products had a pour point of approximately <−39° C. as per IS: 1448: P-10.
c. The Polyol complex esters showed superior flash points 210-232° C. against the specification as per ASTM D: 92.
d. The biodegradability of the synthesized ester is above 95% as per the standard ASTM D: 5864 test method for biodegradability.
e. The products are non toxic to the sewage bacteria.
f. The conventional additives which are suitable for mineral oils are also giving positive response with this ester.
g. The products have good anti wear properties with wear scar diameter of 0.350 mm at 40 kgf load as per ASTM D: 4172B.
h. The products have excellent load bearing capacity.
i. The products have good lubricity.
j. The products have good oxidative stability.
k. The products have no evaporation loss.
l. The products have good adherence to metal characteristics.
m. The products have good corrosion inhibiting characteristics.
n. The synthesized polyol complex esters are comparable with an eco friendly and biodegradable MEMS lube base oils meeting the requirements of commercial chronometers and other delicate instruments oils specifications.
o. Synthetic biodegradable polyol complex ester lubricating oils have excellent biodegradability, a high viscosity index and a low pour point, a high flash point, very good lubricity, good oxidative stability and property of preventing corrosion and suitable for use with sealing materials.
p. The synthesis process employed yielded high purity polyol complex esters with negligible acidity. The products obtained by this invention can be used as a biodegradable and ecofriendly lubricants for MEMS chronometers and other delicate instrument oils which are completely ecofriendly, biodegradable as per ASTM D: 5864-2009 method where as hitherto conventional MEMS oils are not biodegradable containing mineral oil and PFPEs as base stock and synthesized by using conventional catalysts.

The homogenous catalyst is Indion 140, which is a cationic ion exchange resin of macro porous cross-linked poly styrene (H+ ion 4.8 minimum dry, meq/gm, Wet, meq/ml 1.7 minimum) in —$SO_3H$ form with maximum operating temperature 150° C. Its appearance is grey spherical dry beads with particle size in the range of 0.42-1.2 mm. It contains 5% (maximum) moisture with pH in the range of 0-7.

So far no lube base oils having polyol complex esters as base oils, polyol alcohols with di carboxylic acids and mono alcohol with ion exchange resin catalyst have been reported as lubricants for lubrication of delicate bearings, gears, gauges, meters, clocks etc. used in MEMS based devices.

The present work is the development of new ecofriendly and biodegradable MEMS bio lube base oils which comprises, polyol alcohols (2,2-dimethyl-1,3-propane diol, 2,2-diethyl-1,3-propane diol, dibasic acids (adipic and azelaic) and mono alcohol(2-ethyl 1-hexanol) as end capping agent and non conventional indigenous commercial ion exchange resin Indion 140 catalyst with commercial additives. For the synthesis of MEMS bio lube base esters optimized reaction conditions are 1:2:2 mole of Polyol alcohol-di basic acid-mono alcohol, 25% non conventional ion exchange resin catalyst and reaction temperature 107 to 115° C. offering a conversion of 90-95% to ester. Non toxicity and biodegradability of the product and replacement to known commercial chronometer and other precision instrument oil products. The commercially available products are not biodegradable and are toxic containing mineral oils, fluoro ethers and PFPE lubricants as base stocks and synthesized by using conventional catalysts.

The present invention uses non conventional, indigenous, ion exchange resin catalysts, use of commercial additives, Non toxicity and biodegradability, Replacement to known commercial chronometers and other delicate precision instrument oil products which are conventional Mineral oils, fluoro ethers and PFPE based lubricants having toxicity, non-biodegradability, limited performance and life.

Significant technical advancement of the invention by using second step esterification i.e. use of mono alcohol are:

Complex esters are made via the reaction of a polyol, a di carboxylic acid and a mono alcohol as end caping agent. Compared to di and polyol esters, these complex esters synthesized by using 2-ethyl hexanol as end capping agent have higher viscosities, due to formation of dimer, trimer and other oligomers. Complex esters prepared by this process have high conversion of the polyol moieties with low acid and hydroxyl number.

Esters are normally synthesized by using p-toluene sulfonic acid, Ni, Cu, Fe, V, Co, and Sn based catalysts, Cu, Cr, oxides, alkoxy zirconate and heteropoly acids. In these processes the catalysts are used for once through application, have disposal problems, yield base oils which required continuous monitoring and somewhat inferior quality base oils with significant acidity and charred products.

In the present investigation complex esters have been synthesized by using indigenous commercial ion exchange resin catalyst. The use of this catalyst has advantages over conventional catalysts, being indigenous and recycled two times without loss of reactivity. The process has superiority with respect to easy handling less reaction time lower molar ratio of alcohol to acid, high purity and cost effectiveness because of their recyclable nature and yields of the order of 90% and above. A simple cost effective efficient process for making synthetic complex ester base oils by use of a new catalyst system from indigenous raw materials has been developed for MEMS applications. The representative complex esters are as follows:

1. 2,2-diethyl, 1,3-Propane-Di azelaic-2-ethyl-1-hexanoate

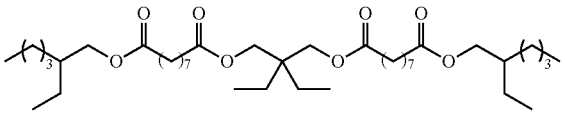

2. 2,2-dimethyl, 1,3-Propane-Di adipic-2-ethyl-1-hexanoate

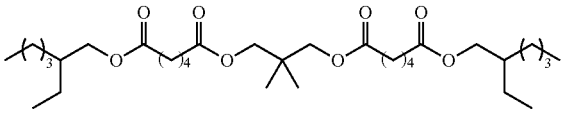

EXAMPLES

The following examples are given by way of illustration of the working of invention in actual practice and should not be construed to limit the scope of present invention in any way.

Example-1

2,2-dimethyl 1,3-propane di adipic 2 ethyl 1 hexanoate (DMADEH)

To a mixture of 2,2-dimethyl 1,3-propane diol and adipic acid (1:2:2 mole, 10.4 g and 29.2 g) respectively was added 25% (16.2 g) of Indion 140 catalyst and toluene 100 ml. The contents were stirred by a mechanical stirrer and refluxed for 4 to 5 hours at 107 to 115° C., to get half ester half acid. After the removal of 3.6 ml of water (1st stage) the mixture was cooled and the contents were reacted with 2-ethyl-1-hexanol (26.0 g) under reflux until all the remaining —COOH groups were esterified. The reaction was completed in 8.30 hours by collecting 3.6 g of water (2nd stage) (3.6 g theoretical). The yield of the product was 92.8% conversion and unreacted materials were distilled out at 72° C. under vacuum (2 mm Hg). The product shows viscosities of 323.98, 31.00 at 0° C. & 40° C. respectively, viscosity index of 161 and pour point of >−39° C.

The formulation is prepared using the Polyol ester: Anti oxidant (1%):ZDDP 1.5 of the polyol ester

Example-2

2,2-dimethyl 1,3-propane diazelaic 2 ethyl 1 hexanoate (DMAZEH)

Experiment-1 was repeated under identical conditions except changing the aliphatic dicarboxylic acid, i.e., azelaic acid. 1:2:2 mole polyol, dicarboxylic acid, aliphatic mono alcohol (10.4 gms+37.6 gms+26.0 gms) and Indion 140 catalyst 25% (18.3 gms) respectively. The reaction was completed in 8.45 hours by collecting 3.6 g of experimental water (3.6 g theoretical). After the removal of water the contents were further heated for 1 to 2 hours, cooled, filtered, and 85 ml of solvent (toluene) was recovered. The yield of the product was 93.7%. The product shows lower viscosities of 5.60, 25.44 at 100° C. and 40° C. respectively, viscosity index of 169 and pour point of >−27° C.

Example-3

2,2-dimethyl 1,3-propane disebacid 2 ethyl 1 hexanoate (DMSEH)

Experiment 1 was repeated under identical conditions except changing the acid part (1:2:2 moles, DMPD, Sebacic acid, 2-ethyl-1-hexanol (10.4 g+40.4 g+26.0 g) and 25% (19 g) Indion 140 catalyst respectively. The reaction was completed in 9 hours by collecting 3.6 g of experimental water in both the stages (3.6 g theoretical). After the removal of water the contents were further heated for 1 to 2 hours, cooled, filtered and 80 ml of solvent (toluene) was recovered. The yield of product was 91%. The product shows lower viscosities of 14.8, 90.33 at 100° C. and 40° C. respectively, viscosity index of 172 and pour point of >−24° C.

Example-4

2,2-diethyl 1,3-propane di adipic 2 ethyl 1 hexanoate (DEADEH)

To a mixture of 2,2-diethyl-1,3-propane diol and adipic acid (1:2 mole 13.2 g+29.2 g) respectively was added 25% (17.0 g) of Indion 140 catalyst and toluene 100 ml. The contents were stirred by a mechanical stirrer and refluxed for 4 to 5 hours at 111° C., to get half ester half acid. After the removal of 3.6 g of water (1st stage) the mixture was cooled and the contents were reacted with 2-ethyl-1-hexanol (26 g) under reflux until all the remaining carboxylic groups were esterified. The reaction was completed in 5.45 hours by collecting 3.6 g of water (2nd stage) (3.6 g theoretical water). After the removal of water, the contents were further heated for 1-2 hours, cooled, filtered and 85 ml of toluene was recovered by vacuum distillation. The yield of the product was 92.1%. The product shows lower viscosities of 12.83, 91.3 at 100° C. and 40° C. respectively, viscosity index of 138 and pour point of >−24° C.

Example-5

2,2-diethyl 1,3-propane diazelaic 2 ethyl 1 hexanoate (DEAZEH)

Experiment 4 was repeated under identical conditions except changing the aliphatic dicarboxylic acid, i.e., azelaic acid 1:2:2 mole DEPD, Azilaic acid, 2-ethyl-1-hexanol (13.2 g+37.6 g+26 g) and 25% (19 g) of Indion 140 catalyst respectively. The reaction was completed in 9 hours by collecting 3.6 g of experimental water in both the stages (3.6 g theoretical). After the removal of water the contents were further heated for 1 to 2 hours, cooled, filtered and 85 ml of solvent (toluene) was recovered. The yield of the product was 90.2%. The product shows lower viscosities of 408.23, 47.0 at 0° C. and 40° C. respectively, viscosity index of 171 and pour point of >−39° C.

The formulation is prepared using the polyol ester: Anti oxidant (1%):ZDDP 3.5 of the polyol ester.

Example-6

2,2-diethyl 1,3-propane disebacic 2 ethyl 1 hexanoate (DESEH)

Experiment 4 was repeated under identical conditions except changing the acid, i.e., sebacic acid 1:2:2 mole DEPD, sebacic acid, 2-ethyl 1-hexanol (13.2 g+40.4 g+26.0 g) and 25% of (19.7 g) Indion 140 catalyst respectively. The reaction was completed in 9.45 hours by collecting 3.6 g of experimental water in both the stages (3.6 g theoretical). After the removal of water, the contents were further heated for 1 to 2 hours, cooled, filtered and 80 ml of solvent (toluene) was recovered. The yield of the product was 91.9%. The product shows lower viscosities of 7.24, 36.8 at 100° C. and 40° C. respectively, viscosity index of 165 and pour point of >−39° C.

Example-7

1,1,1-trishydroxymethyl propane triadipic 2 ethyl 1 hexanoate (THADEH)

To a mixture of THMP and adipic acid 1:3 mole (13.4 g+43.8 g) respectively was added 25% (23.7 g) of Indion 140 catalyst and toluene 100 ml. The contents were stirred by a mechanical stirrer and refluxed for 4 to 5 hours at 111° C., to get half ester half acid. After the removal of 8.4 g of experimental water (1st stage) the mixture was cooled and the contents were reacted with 2-ethyl 1-hexanol (39 g) under reflux until all the remaining carboxylic groups were esterified. The reaction was complete in 10.25 hours by collecting 5.4 g of water (2nd stage) (5.4 g theoretical). After the removal of water the contents were further heated for 1 to 2 hours, cooled, filtered, and 80 ml of toluene was recovered by vacuum distillation. The yield of the product observed was 94.4%. The product shows lower viscosities of 10.17, 26.51 at 100° C. and 40° C. respectively, viscosity index of 196 and pour point of >−15° C.

Example-8

1,1,1-trishydroxymethyl propane triazilaic 2 ethyl 1 hexanoate (THAZEH)

Experiment 7 was repeated under identical conditions except changing the acid part i.e., azilaic acid 1:3:3 mole THMP, azilaic acid, 2-ethyl-hexanol (13.4 g+56.4 g+39 g) and 25% of (27 g) Indion 140 catalyst respectively. The reaction was completed in 9.45 hours by collecting 5.4 g and 5.2 g in both the stages (5.4 g theoretical). After the removal of water the contents were further heated for 1 to 2 hours, cooled, filtered and 80 ml of solvent (toluene) was recovered. The yield of the product was 92.7%. The product shows lower viscosities of 8.53, 46.07 at 100° C. and 40° C. respectively, viscosity index of 165 and pour point of >−27° C.

Example-9

1,1,1-trishydroxymethyl propane trisebacic 2 ethyl 1 hexanoate (THSEH)

Experiment 7 was repeated under identical conditions except changing the acid part, i.e., sebacic acid 1:3:3 mole THMP, sebacic, 2-ethyl-hexanol (13.4 g+60.6 g+39 g) and 25% (28 g of Indion 140 catalyst respectively. The reaction was completed in 10.45 hours by collecting 5.4 g of experimental water in both the stages (5.4 g theoretical). After the removal of water (theoretical), content was further heated for 1 to 2 hours, cooled, filtered, and 80 ml of solvent (toluene) was recovered. The yield of the product was 94.3%. The product shows lower viscosities of 16.87, 111 at 100° C. and 40° C. respectively, viscosity index of 196 and pour point >−24° C.

Based on the experiments 1-9, the physico-chemical characterization and performance evaluation of the products shows, examples 1 and 5 are matching the viscosities at 40° C. and other properties mentioned in the (IS-1088, 2004) specifications of lubricants for chronometers and are suitable as MEMS lubricants.

The examples 10 & 11 given below are formulated with anti oxidant and EP additives to improve the oxidation and extreme pressure properties.

Example-10

Experiment 5 was repeated under identical conditions except changing the aliphatic dicarboxylic acid, i.e., azelaic acid 1:2:2 mole DEPD, Azelaic acid, 2-ethyl-1-hexanol (13.2 g+37.6 g+26 g) and 25% (19 g) of catalyst respectively. The reaction was completed in 9 hours by collecting 3.6 g of experimental water in both the stages (3.6 g theoretical). After the removal of water the contents were further heated for 1 to 2 hours, cooled, filtered and 85 ml of solvent (toluene) was recovered. The yield of the base oil product was 90.2%. The product shows lower viscosities of 408.23, 47.0 at 0° C. and 40° C. respectively, viscosity index of 171 and pour point of >−39° C.

The base oil is blended at recommended dose of 1% anti oxidant 2,6-di tertiary butyl 4, methyl Phenol (BHT) and 4% Zinc dialkyl dithio phosphate (ZDDP) based on the base oil. ZDDP is with alkyl groups containing branched and linear alkanes between 1-14 carbon lengths. A mixture of zinc dialkyl (C3-C6) dithiophosphates comes under CAS number 84605-29-8 as multifunctional EP additive.

Example-11

To a mixture of 2,2-dimethyl 1,3-propane diol and adipic acid (1:2:2 mole, 10.4 g and 29.2 g) respectively was added 25% (16.2 g) of catalyst and toluene 100 ml. The contents were stirred by a mechanical stirrer and refluxed for 4 to 5 hours at 107 to 115° C., to get half ester half acid. After the removal of 3.6 ml of water (1st stage) the mixture was cooled and the contents were reacted with 2-ethyl-1-hexanol (26.0 g) under reflux until all the remaining —COOH groups were esterified. The reaction was completed in 8.30 hours by collecting 3.6 g of water (2nd stage) (3.6 g theoretical). The yield of the base oil product is 92.8% conversion and unreacted materials were distilled out at 72° C. under vacuum (2 mm Hg). The product shows viscosities of 323.98, 31.00 at 0° C. & 40° C. respectively, viscosity index of 161 and pour point of >−39° C.

The base oil is blended at recommended dose of 1% anti oxidant 2, 6-di tertiary butyl 4, methyl Phenol (BHT) and 2.5% Zinc dialkyl dithio phosphate (ZDDP). The ZDDP use is with alkyl groups containing branched and linear alkanes between 1-14 carbon length. A mix of zinc dialkyl (C3-C6) dithiophosphates comes under CAS number 84605-29-8 as multifunctional EP additive.

Example-12

Mixture of (DMADEH) and (DEAZEH)

Lubricant mixtures were prepared using synthesized non-conventional complex polyol lube base stock, which was blended with the known quantity of the other complex polyol. The blends in 1:1 and 1:2 ratios were homogenized by rigorous stirring on a magnetic hot plate at 100° C. for 2 hours. The complex polyol esters were easily mixed into homogeneous and clear blends. The lubricant blends reported no separation before and after the test. The as prepared lubricant blends were tested for their physico chemical properties and tribological performance.

Example-13

2,2-dimethyl 1,3-propane di adipic 2 ethyl 1 hexanoate (DMADEH)

Experiment-1 was repeated under identical conditions except increasing the reaction temperature to (138° C.) as xylene was used as solvent. The reaction was completed in 6 hours and yield observed was 96%. On increasing the reaction temperature the reaction time and yield almost remains same. Hence the optimized reaction temperature for esterification was 107-115° C.

Example-14

2,2-dimethyl 1,3-propane di adipic 2 ethyl 1 hexanoate (DMADEH)

Experiment-1 was repeated under identical conditions with 20% wt of Indion 140 catalyst. To a mixture of 2,2-dimethyl 1,3-propane diol and adipic acid (1:2:2 mole) was added 20% of Indion 140 catalyst and toluene 100 ml. The contents were stirred by a mechanical stirrer and refluxed for 4 to 5 hours at 111° C., to get half ester half acid. After the removal of water (1st stage) the mixture was cooled and the contents were reacted with 2-ethyl-1-hexanol under reflux until all the remaining —COOH groups were esterified. The reaction was completed in 8.30 hours by collecting 70% of water (2nd stage). The yield of the product was 78.8% conversion and unreacted materials were distilled out at 72° C. under vacuum (2 mm Hg).

Example-15

2,2-dimethyl 1,3-propane diadepic 2 ethyl 1 hexanoate; (DMADEH)

Experiment-1 was repeated under identical conditions except increasing the Indion 140 catalyst to 25% wt. The reaction was completed in 8.30 hours by collecting 100% of experimental water (theoretical) 95 ml of solvent (toluene) recovered with the conversion of 92.8%.

Example-16

2,2-dimethyl 1,3-propane di adipic 2 ethyl 1 hexanoate; (DMADEH)

Experiment-1 was repeated under identical conditions except increasing the catalyst to 30% wt. The reaction was completed in 8.30 hours with the conversion of 92.8%.

Based on the above 12-14 experiments Indion 140 catalyst percentage used for esterification reaction under the optimized conditions was 25 wt %.

Reactivity of the Catalyst

In order to ensure life of the Indion 140 catalyst, the recovered catalyst was thoroughly washed with excess solvent (toluene) and dried at room temperature. The catalyst is recycled twice without any loss of reactivity.

Example-17

2,2-dimethyl 1,3-propane di 2 ethyl 1 hexanoate (DMADEH)

Experiment-1 was repeated under identical conditions (1:2:2 mole of 2,2-dimethyl 1,3-propane diol, 2,2-di ethyl 1,3-propane diol/adipic, azelaic, sebacic acids/2-ethyl 1-hexanol) and 25% wt of Indion 140 catalyst. The reaction was completed in 8.30 hours and yield observed was 92.8%. The Indion 140 catalyst was recycled two times without any loss of reactivity, only reaction time was increased. At third time even after 18 hours, the reaction was not complete and yield observed was 40%.

For the synthesis of the MEMS complex esters of DMPD and DEPD with adipic, azelaic acids and 2-ethyl-1-hexanol the optimized reaction conditions are 1:2:2 mole polyol, di acid and mono alcohol, 25% non conventional ion exchange resin Indion 140 catalyst and reaction temperature 107 to 115° C. offering a conversion of 90% to 95% to ester.

The properties of synthesized products are compared with BIS specification 1088 for mineral oil based formulations and results are given below in table 1. The properties are better than BIS specification.

TABLE 1

Comparison of physico chemical characteristics of synthesized products with BIS specification

| Characteristics | Requirements of BIS specifications | DEAZEH | DMADEH | Method |
|---|---|---|---|---|
| Molecular weight | | 696 | 584 | ASTM D: 2503, 1997 |
| Molecular formula | | $C_{41}H_{76}O_8$ | $C_{33}H_{60}O_8$ | |
| Density, $d_4^{20}$ gm/ml | | 0.9627 | 0.9915 | ASTM D: 4052 |
| KV in cst at 40° C., Min | 30.0 | 47.00 | 31.00 | P-25 |
| 0° C., Max | 330.0 | 408.23 | 323.98 | |
| −35° C., Max | 10000.0 | >5000 | >4000 | |
| Viscosity Index, Min | 125 | 171 | 161 | P-56 |

TABLE 1-continued

Comparison of physico chemical characteristics of synthesized products with BIS specification

| Characteristics | Requirements of BIS specifications | DEAZEH | DMADEH | Method |
|---|---|---|---|---|
| Oxidation stability, changes after test | | | | |
| appearance | No Turbity | No Turbity | No Turbity | |
| KV in cst at 40° C., Min | 10 | 9.5 | 8.5 | P-25 |
| Copper spiral | No sign of corrosion | No corrosion | No corrosion | |
| Evaporation loss, % by mass, Max | 1 | 0.42 | 0.48 | P-136 |
| Adherence to metal, change in diameter of the drop, percent, Max | 15 | 13 | 12 | |
| Protection | | | | |
| Appearance of oil | No change in colour | Clear yellow | Clear yellow | |
| Steel cube | No corrosion | No corrosion | No corrosion | |
| Brass cube | No discoloration | No discoloration | No discoloration | |
| Pour Point ° C., | −39 | <−39 | <−39 | P-10 |
| Max Acidity, (mg KoH/gm of oil), Max | | | | P-2 |
| Inorganic | Nil | Nil | Nil | |
| Organic | 1.0 | 0.0635 | 0.0817 | |
| Steel/steel | 0.155 | 0.098 | 0.117 | |

The synthesized products also have good tribological properties as given in Table 2.

TABLE 2

Tribological performance of synthesized products

| Characteristics | DEAZEH | DMADEH |
|---|---|---|
| Weld Load(kgf) | 240 | 190 |
| Wear Scar Diameter(mm) | 0.350 | 0.425 |
| EHD film thickness at 30N (nm) | 145 | 180 |
| Average friction coefficient at 30N (μm) | 0.098 | 0.117 |
| EHD scar dia meter at 30N(μm) | 186 | 182 |

DEAZEH: 2-diethyl, 1,3-Propane-Di azelaic-2-ethyl-1-hexanoate
DMADEH: 2,2-dimethyl, 1,3-Propane-Di adipic-2-ethyl-1-hexanoate

Advantages of the Invention

1. Superior alternative to conventional mineral oil and Perfluoropolyether based commercial MEMS lube base oils on account of its ecofriendly and biodegradable nature.
2. The main advantages of synthesized products are good lubricity properties.
3. The main advantage of synthesized product is having excellent load bearing capacity.
4. The main advantage of synthesized product is conventional additives which are suitable for mineral oils are also giving positive response with this ester.
5. The main advantage of synthesized product is it passes the 100 hour oxidation stability test. After this anti wear and anti oxidant additives 2, 6-di tertiary butyl 4, methyl Phenol was used.
6. The synthesized polyol complex esters are good potential for use as biodegradable base stock for formulation of new eco-friendly and biodegradable MEMS chronometers and other delicate instrument oils.
7. The main advantage of synthesized product is the use of non conventional indigenous commercial Indion-140 ion exchange resin catalyst.
8. The product synthesized by using non conventional catalysts is a new potential candidate, for biodegradable MEMS chronometers and other delicate instruments oils which is completely ecofriendly, biodegradable and a replacement for currently being used conventional based products which are toxic and non-biodegradable.

We claim:

1. A lubricant, wherein the lubricant comprises:
polyol complex ester selected from the group consisting of 2,2-diethyl-1,3-propane-di-azelaic-2-ethyl-1-hexanoate; 2,2-dimethyl-1,3-propane-di-adipic-2-ethyl-1-hexanoate, and a mixture thereof, wherein the polyol complex is in the range of 94% to 100%;
an antioxidant in the range of 0-2%; and
an additive in the range of 0 to 4%; and
wherein the lubricant is free of mineral oil.

2. The lubricant as claimed in claim 1, wherein the ratio of polyol complex esters is in the range of 1:1 to 1:3.

3. The lubricant as claimed in claim 1, wherein the ratio of polyol complex ester is 1:1.

4. The lubricant as claimed in claim 1, wherein the antioxidant is selected from the group consisting of 2,6-di tertiary butyl 4, methyl Phenol (BHT), alkylated diphenylamine, 3,7-di-t-octylphenothiazine, alkylated PANA, and di-t-butyl-p-cresol (DBPC).

5. The lubricant as claimed in claim 1, wherein the additive is selected from the group consisting of Zinc dialkyl dithio phosphate (ZDDP), 5,5-dithiobis-(1,3,4-thiadiazole-2(3H)-thione), Di Methyl Hydrogen Phosphite, Di Butyl Hydrogen Phosphite, Di-n-Octyl Hydrogen Phosphite, Di-2-Ethylhexyl Hydrogen Phosphite, Di Oleyl Hydrogen Phosphite, Di Lauryl Hydrogen Phosphite, Tri-Lauryl Tri Thiophosphite, Tri-Lauryl Phosphite, Tri-$C_{12}$-$C_{14}$ Phosphite, and Tri-$C_{12}$-$C_{14}$ Phosphite.

6. A process for synthesizing the mineral oil free lubricant wherein the process comprises the steps of:
(i) reacting a mixture of polyol of $C_3$-$C_5$ carbon, dicarboxylic acid of $C_6$-$C_{10}$ carbon in a ratio of 1:2 in presence of a heterogeneous catalyst and a solvent at refluxing temperature for a period ranging between 2 to 4 hours to obtain a reaction mixture;

(ii) removing water from said reaction mixture and allowing the mixture to cool to obtain cooled mixture;

(iii) reacting the cooled mixture obtained at step (ii) with at least 2 moles of mono alcohol under reflux condition until all remaining carboxylic groups are esterified, and completing the reaction in a period ranging from 8 to 12 hours, until water is removed to obtain Polyol complex esters as base oil; and (iv) blending the base oil obtained at step (iii), wherein the base oil is 94% to 100% with antioxidant 1-2% and an additive 1.5 to 4%, to obtain the mineral oil free lubricant.

7. The process as claimed in claim 6, wherein the polyol is selected from the group consisting of 2, 2-dimethyl 1, 3-propane diol, and 2, 2-diethyl-1, 3-propane diol.

8. The process as claimed in claim 6, wherein the dicarboxylic acid ($C_6$-$C_{10}$) is selected from the group consisting of adipic acid, and azelaic acid.

9. The process as claimed in claim 6, wherein the mono alcohol in step (iii) is selected from the group consisting of 2-ethyl-1-hexanol, isooctanol, nonanol, and isodecanol.

10. The process as claimed in claim 6, wherein the solvent is selected from toluene or xylene.

11. The process as claimed in claim 6, wherein the antioxidant is selected from the group consisting of 2,6-di tertiary butyl 4, methyl Phenol (BHT), alkylated diphenylamine, 3,7-di-t-octylphenothiazine, alkylated PANA, and di-t-butyl-p-cresol (DBPC).

12. The process as claimed in claim 6, wherein the additive is selected from the group consisting of Zinc dialkyl dithio phosphate (ZDDP), 5,5-dithiobis-(1,3,4-thiadiazole-2 (3H)-thione), Di Methyl Hydrogen Phosphite, Di Butyl Hydrogen Phosphite, Di-n-Octyl Hydrogen Phosphite, Di-2-Ethylhexyl Hydrogen Phosphite, Di Oleyl Hydrogen Phosphite, Di Lauryl Hydrogen Phosphite, Tri-Lauryl Tri Thiophosphite, Tri-Lauryl Phosphite, Tri-$C_{12}$-$C_{14}$ Phosphite, and Tri-$C_{12}$-$C_{14}$ Phosphite.

13. The process as claimed in claim 6, wherein the heterogeneous catalyst is Styrene di-vinyl benzene copolymer resin with sulphonic acid functionality.

14. The process as claimed in claim 6, wherein the reaction temperature in steps (i) and (ii) is in the range of 107-115° C. at atmospheric pressure.

15. A polyol complex ester selected from the group consisting of:

(i) 2, 2-diethyl 1, 3-propane di adipic 2 ethyl 1 hexanoate (DEADEH), (ii) 2, 2-diethyl 1, 3-propane diazelaic 2 ethyl 1 hexanoate (DEAZEH), (iii) 2, 2-diethyl 1, 3-propane disebacic 2 ethyl 1 hexanoate (DESEH), (iv) 1, 1, 1-trishydroxymethyl propane triazilaic 2 ethyl 1 hexanoate (THAZEH), (v) 1,1, 1-trishydroxymethyl propane trisebacic 2 ethyl 1 hexanoate (THSEH), and (vi) 1, 1, 1-trishydroxymethyl propane triadipic 2 ethyl 1 hexanoate (THADEH).

* * * * *